US009211430B1

(12) United States Patent
Higginbotham, III

(10) Patent No.: US 9,211,430 B1
(45) Date of Patent: Dec. 15, 2015

(54) EXERCISE APPARATUS AND METHOD

(76) Inventor: Hugh R. Higginbotham, III, North Palm Beach, FL (US)

( * ) Notice: Subject to any disclaimer, the term of this patent is extended or adjusted under 35 U.S.C. 154(b) by 140 days.

(21) Appl. No.: 11/391,827

(22) Filed: Mar. 29, 2006

(51) Int. Cl.
*A63B 21/05* (2006.01)
*A63B 21/00* (2006.01)

(52) U.S. Cl.
CPC ..... *A63B 21/0004* (2013.01)

(58) Field of Classification Search
USPC ..... 482/1–148
See application file for complete search history.

(56) References Cited

U.S. PATENT DOCUMENTS 2,529,347 A * 11/1950 Ross, Jr. et al. ..... 482/126
4,022,463 A * 5/1977 Scott, Jr. ..... 482/122
4,861,022 A * 8/1989 Boatcallie ..... 482/126
5,360,385 A * 11/1994 Wang ..... 482/49
5,399,138 A * 3/1995 Jones ..... 482/127
5,496,245 A * 3/1996 Du Verney ..... 482/126
5,507,712 A * 4/1996 Chang ..... 482/126
5,613,928 A * 3/1997 Laudone ..... 482/139
5,626,545 A * 5/1997 Newman et al. ..... 482/127
5,674,164 A * 10/1997 Kravitz ..... 482/126
5,741,207 A * 4/1998 Buoni et al. ..... 482/124
5,860,944 A * 1/1999 Hoffman, Jr. ..... 602/19
7,267,641 B2 * 9/2007 Hsieh ..... 482/111
7,789,815 B2 * 9/2010 An ..... A63B 21/0004 482/126
7,828,704 B1 * 11/2010 Hsieh ..... A63B 21/0004 482/121

* cited by examiner

*Primary Examiner* — Stephen Crow
(74) *Attorney, Agent, or Firm* — McHale & Slavin, P.A.

(57) ABSTRACT

Exercise apparatus includes a pair of L-shaped frame members that are joined by a central pivot, a concave arm engaging member attached to each of the frame members, and a spring mechanism holding the frame members pivoted in an extended condition. Exercises are performed by moving the frame members together and apart while holding each forearm in one of the concave members, with a forward-extending leg of each L-shaped member being held as a handgrip. The apparatus may also be converted for use in leg exercises.

19 Claims, 5 Drawing Sheets

EXERCISE APPARATUS AND METHOD

BACKGROUND OF THE INVENTION

1. Field of the Invention

This invention relates to exercise apparatus, and, more particularly, to portable apparatus for exercising the muscles of the shoulders and back.

2. Summary of the Background Art

Conventional exercise apparatus generally falls into a portable category including a number of devices having one or more handles operated by one hand or by both hands in unison, or into a stationary category of floor-standing devices that include various handle and pads engaging various portions of the human body. Within the portable category, exercise devices include coil springs, torsion springs, or elastic bands that absorb energy as handles are squeezed together or pulled apart. Small weights, such as dumbbells, can be used to perform a number of exercises and may be considered portable, although they are more difficult to carry because of their weight. Within the stationary category, exercise devices include large frames that are often bolted to the floor and body engaging members, such as handles and pads connected to energy absorbing mechanisms by pivoted levers or cables. While such stationary devices have an advantage of flexibility, allowing them to be used to perform exercises on various muscle groups, their nature limits their availability to gymnasiums or to residences having a separate exercise room. Thus, what is needed is a portable device having concave arm engaging members as well as handles, so that the device can be used to exercise muscles in the chest, arms, shoulders and upper back.

SUMMARY OF THE INVENTION

In accordance with one aspect of the invention, exercise apparatus is provided including a central pivot, a pair of L-shaped frame members, a pair of concave arm-engaging members, and a spring mechanism, such as a mechanism including a metal spring or an elastic band. The L-shaped frame members are pivotally attached to one another at the central pivot. Each of the L-shaped frame members includes an outward-extending leg extending outward from the central pivot and a forward-extending leg of sufficient length to form a hand grip, extending forward from the central pivot perpendicular to the outward-extending leg. Each of the concave arm engaging members is attached to extend forward from one of the outward-extending legs. The spring mechanism applies a force acting between the L-shaped members to oppose pivoting movement of the L-shaped frame members between an extended condition, in which the outward-extending legs extend outward with a first acute angle between the outward-extending legs, and a compressed condition, in which the outward-extending legs extend rearward with an angle less than the first acute angle between the outward-extending legs.

Such apparatus is used to perform an exercise beginning with placing each forearm within one of the concave arm engaging members of an L-shaped frame member while gripping the forward-extending legs of the L-shaped frame members with the hands, so that the exercise apparatus is held in its extended condition. Then, each upper arm is moved downward, with each forearm pivoting forward from the elbow, as the exercise apparatus is moved into its compressed condition against a resistive force provided by the spring mechanism. Next, the upper arms are moved upward, with each forearm pivoting rearward from the elbow, as the exercise apparatus returns to its extended condition. These arm movements are then repeated a number of times.

In one version of the apparatus, each of the forward-extending legs includes a pin extending forward from its end, and the spring mechanism includes at least one elastic strap extending between the ends of the forward-extending legs, with holes at opposite ends of the elastic strap(s) engaging the pins in the forward-extending legs.

In another version of the apparatus, each of the forward-extending legs includes a slot facing the other forward-extending leg. In this version, the spring means includes at least one elastic member having a central elastic portion and a ball at each end. The balls at the end of each elastic member hold the elastic member in place within the forward-extending legs, with the central portion extending between the slots in the forward-extending legs. Preferably, the slot within each of the forward-extending legs extends into an opening within an end of the forward-extending leg, with the width of the slot being too small to permit the passage therethrough of one of the balls, but with the opening within each of the legs is large enough to permit passage of one of the balls, allowing the elastic member to be added to the apparatus.

In other versions of the apparatus, the spring mechanism includes a coil spring and a turnbuckle, fastened to one another, extending between ends of the forward-extending legs, or, alternately, a torsion spring, extending around the central pivot, having opposite ends engaging the two L-shaped frame members.

One of the L-shaped frame members may include a flat portion having a pivot hole, while the other L-shaped frame member includes a bifurcated portion having two aligned pivot holes, with the central pivot including a pin extending through the two aligned pivot holes of the bifurcated portion and through the single pivot hole of the flat portion, with the flat portion disposed within the bifurcated portion. The central pivot pin may include a pin having a key portion extending outward from one side, inserted through holes having keyways in the L-shaped frame members, and turned after insertion to hold the pin in place as a pivot. Preferably, a pivoting motion stop is provided to prevent pivoting movement of the L-shaped frame members to increase the angle between the outward extending legs beyond the first acute angle.

Preferably, each of the concave arm engaging members is slidably attached to one of the L-shaped frame members. For example, each of the arm-engaging members may be slidably attached to the outward-extending leg of one of the L-shaped frame members by a slider, to which the arm-engaging member is pivotally attached. Such apparatus may include a clamping screw extending through a slot extending along the length of each of the outward-extending legs to hold one of the sliders in place. Alternately, each of the outward-extending legs may include a plurality of attachment holes spaced apart along its length, with each of the sliders including a pin and a spring holding the pin in engagement with one of the attachment holes.

The exercise apparatus of the invention may be additionally configurable for performing leg exercises. For example, the concave arm engagement members are removably attached to the outward-extending legs, while concave leg engaging members, which are substantially larger in width in the direction of curvature than the concave arm engaging members, are provided for attachment in place of the concave arm attachment members. Alternately, the exercise apparatus may be provided with concave arm engagement members that are variable in width in the direction of curvature to become leg engaging members. A leg exercise is then performed in a sitting position, beginning with placing each upper leg within one of the concave leg engaging members with the outward-extending legs of the L-shaped frame members extending forward and with the upper legs spread apart to hold the exercise apparatus in the extended condition. Then, the upper legs are moved toward one another against the resistive force provided within the exercise apparatus by the spring mechanism. Next, the upper legs are moved apart to return the exercise apparatus to the extended condition. These leg movements are repeated a number of times.

DETAILED DESCRIPTION OF THE INVENTION

Figure 1:
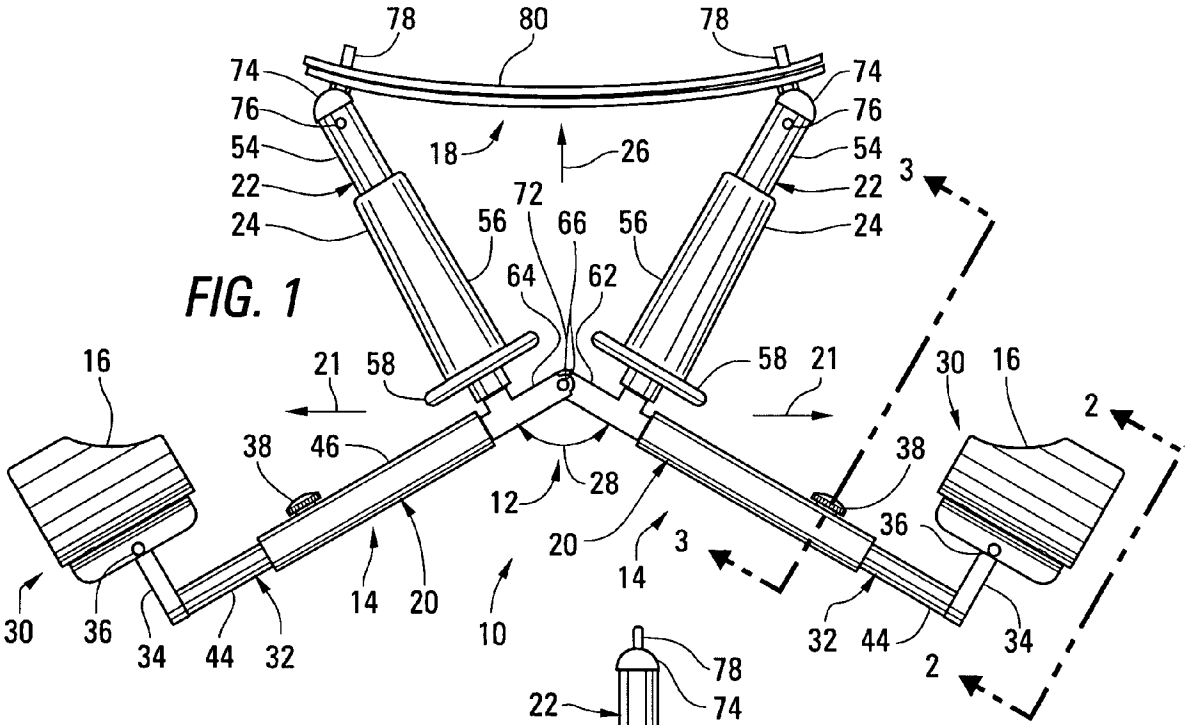
FIG. 1 is a plan view of exercise apparatus built in accordance with a first embodiment of the invention.

FIG. 1 is a plan view of exercise apparatus 10 built in accordance with a first embodiment of the invention to include a central pivot 12, a pair of L-shaped frame members 14, a pair of concave arm-engaging members 16, and a spring mechanism 18. The L-shaped frame members 14 are pivotally attached to one another at the central pivot 12. Each of the L-shaped frame members 14 includes an outward-extending leg 20 extending outward, in the directions indicated by arrows 21, from the central pivot 12 and a forward-extending leg 22 of sufficient length to form a hand grip 24. The forward-extending legs 22 extend in the forward direction of arrow 26 from the central pivot 12, with each of the forward-extending legs 22 being perpendicular to the outward-extending leg 20 of the L-shaped frame member 14. Each of the concave arm engaging members 16 is attached to extend in the forward direction of arrow 26 from one of the outward-extending legs 20. The spring mechanism 18 applies a force acting between the L-shaped members 14 to oppose pivoting movement of the L-shaped frame members 14 between an extended condition, in which the outward-extending legs 20 extend outward with a first acute angle 28 between the outward-extending legs, and a compressed condition, in which the outward-extending legs extend outward with an angle less than the first acute angle 28 between the outward-extending legs 20.

Figure 2:
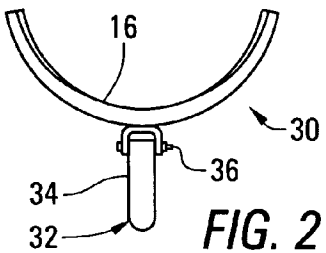
FIG. 2 is an elevation of a concave arm engaging extension within the exercise apparatus of FIG. 1, taken as indicated by section lines 2-2 therein.

FIG. 2 is an elevation, taken as indicated by section lines 2-2 in FIG. 1, of an arm engaging extension 30 that is slidably attached to the outward-extending leg 20 of each of the L-shaped frame members 14. The arm-engaging extension 30 includes a slider 32 having a post 34 to which the concave arm-engaging member 16 is pivotally attached by means of a screw 36.

Figure 3:
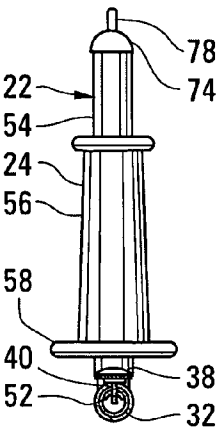
FIG. 3 is a cross-sectional elevation of a frame member holding the concave arm engaging extension within the exercise apparatus of FIG. 1, taken as indicated by section lines 3-3 therein.

FIG. 3 is a cross-sectional elevation, taken as indicated by section lines 3-3 in FIG. 1, of one of the L-shaped frame members 14, showing a clamping screw 38 extending through a slot 40 within the outward-extending leg 20 to hold the slider 32 in place.

Figure 4:
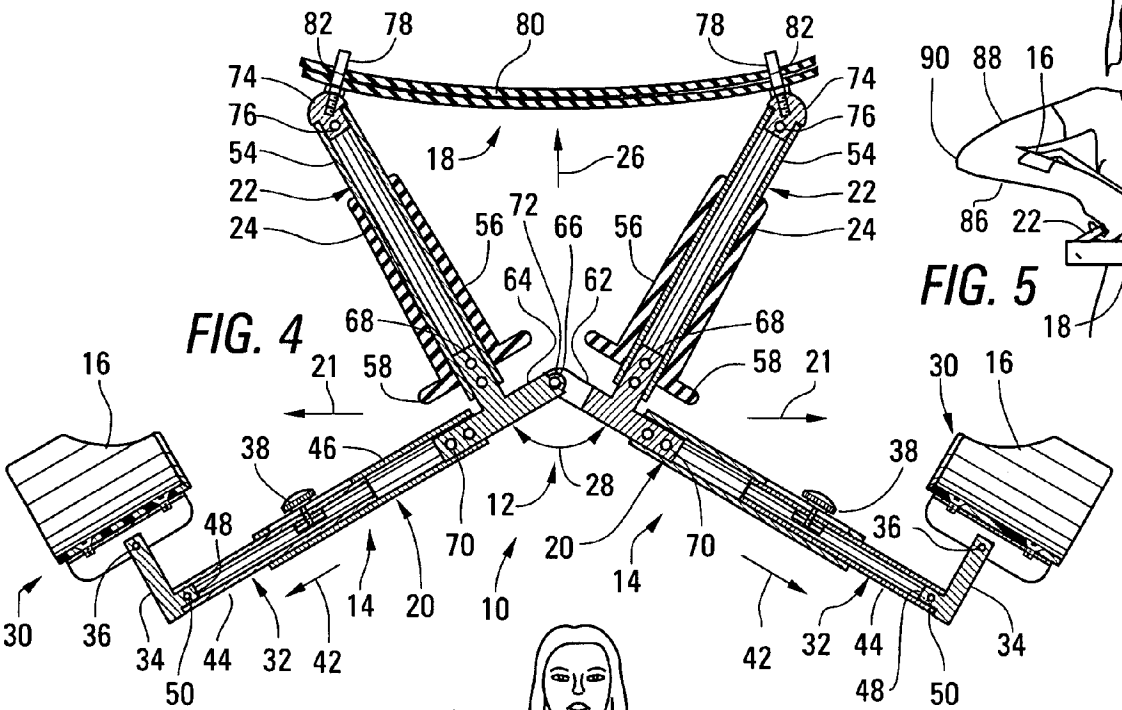
FIG. 4 is a cross-sectional plan view of the exercise apparatus of FIG. 1.

FIG. 4 is a cross-sectional plan view of the exercise apparatus 10, showing the slot 40 as extending along the length of the L-shaped frame member 14 in the direction of arrow 42 to provide for adjustment of the position of the arm-engaging extension 30. The slider 32 is additionally shown as including a tubular portion 44 sliding within a tubular portion 46 of the outward-extending leg 20. The post 34 includes a hub 48, extending within the tubular portion 44 of the slider 32 and fastened therein by a pin 50. Each of the clamping screws 38 engages a curved segment 52 within the tubular portion 44 to hold a slider 32 in place.

Each of the forward-extending legs 22 includes a tubular portion 54 and a handgrip 56 having a flange 58 disposed in the forward direction of arrow 26 from the central pivot 12. The central pivot 12 is formed by a pivot pin 60 extending through a pivot hole within a flat portion 62 of one of the L-shaped frame members 14 and through pivot holes within a bifurcated portion 64 of the other L-shaped frame member 14. Each of the L-shaped frame members 14 includes an attachment fixture 66 fastened within the tubular portion 54 of the forward-extending arm 54 by means of pins 68 and to the tubular portion 46 of the outward-extending arm 30 by means of pins 70, with the attachment fixture 66 including either the flat portion 62 or the bifurcated portion 64. A pivoting motion stop 72 is additionally provided to prevent pivoting movement of the L-shaped frame members 14 to increase the angle between the outward extending legs 20 beyond the first acute angle 28.

Each of the forward-extending legs 22 includes an end cap 74 fastened within the tubular portion 54 by means of a pin 76. The end cap 74 further includes an attachment pin 78 extending forward. The spring mechanism 18 includes at least one elastic strap 80 extending between the end caps 74 of the forward-extending legs 22, with holes 82 at opposite ends of the elastic strap(s) 80 engaging the attachment pins in the forward-extending legs 22.

Figure 5:
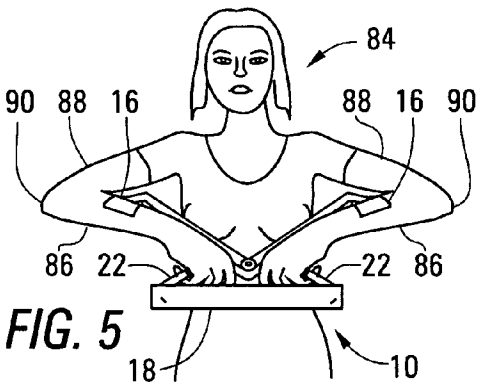
FIG. 5 is a perspective view of the exercise apparatus of FIG. 1, being held in an extended condition by a user.
Figure 6:
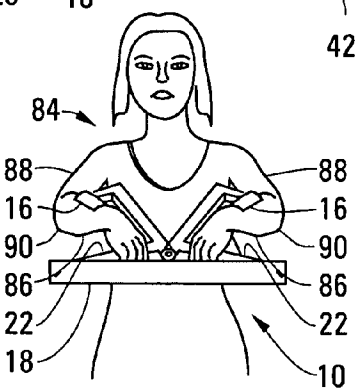
FIG. 6 is a perspective view of the exercise apparatus of FIG. 1, being held in a compressed condition by the user.

An exercise to be performed with the exercise apparatus 10 will now be explained with reference being made to FIGS. 5 and 6. FIG. 5 is a perspective view of a user 84 holding the exercise apparatus 10 in the extended condition, while FIG. 6 is a perspective view of the user 84 holding the exercise apparatus 10 in the compressed condition. The exercise begins with placing each forearm 86 within one of the concave arm engaging members 16 of the exercise apparatus 10 while gripping the forward-extending legs 22 of the L-shaped frame members 20 with the hands, so that the exercise apparatus is held in its extended condition, as shown in FIG. 5. Then, each upper arm 88 is moved forward, with each forearm also pivoting forward from the elbow 90, as the exercise apparatus 10 is moved into its compressed condition, as shown in FIG. 6, against a resistive force provided by the spring mechanism 18. Next, the upper arms 88 are moved outward, with each forearm pivoting rearward from the elbow 90, as the exercise apparatus returns to its extended condition, again as shown in FIG. 5. These arm movements are then repeated a number of times, exercising and strengthening the chest, the arms, the deltoid muscles of the upper arms and shoulders and the trapezius muscles of the upper back.

Figure 7:
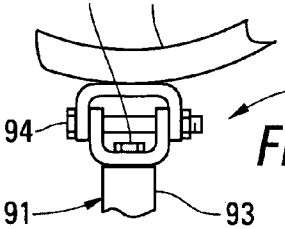
FIG. 7 is a fragmentary elevation of a concave arm engaging extension for use within the exercise apparatus of FIG. 1, showing a first alternative means for attaching a concave arm engaging member therein.

FIG. 7 is a fragmentary end view of a concave arm engaging extension 91 for use within the exercise apparatus 10, showing a first alternative means 92 for attaching the concave arm engaging member 16 to a post 93 within the extension 91, with the concave arm engaging member 16 being allowed to pivot about a first pivot screw 94 and additionally about a second pivot screw 95, extending perpendicular to the first pivot screw 94.

Figure 8:
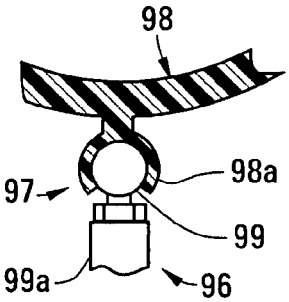
FIG. 8 is a fragmentary cross-sectional elevation of a concave arm engaging extension for use within the exercise apparatus of FIG. 1, showing a second alternative means for attaching a concave arm engaging member therein.

FIG. 8 Is a fragmentary cross-sectional view of a concave arm engaging extension 96 showing a second alternative means 97 for attaching a concave arm engaging member 98 including a socket 98*a* snapped in place to pivot on a ball 99 attached to a post 99*a* within the extension 96.

Figure 9:
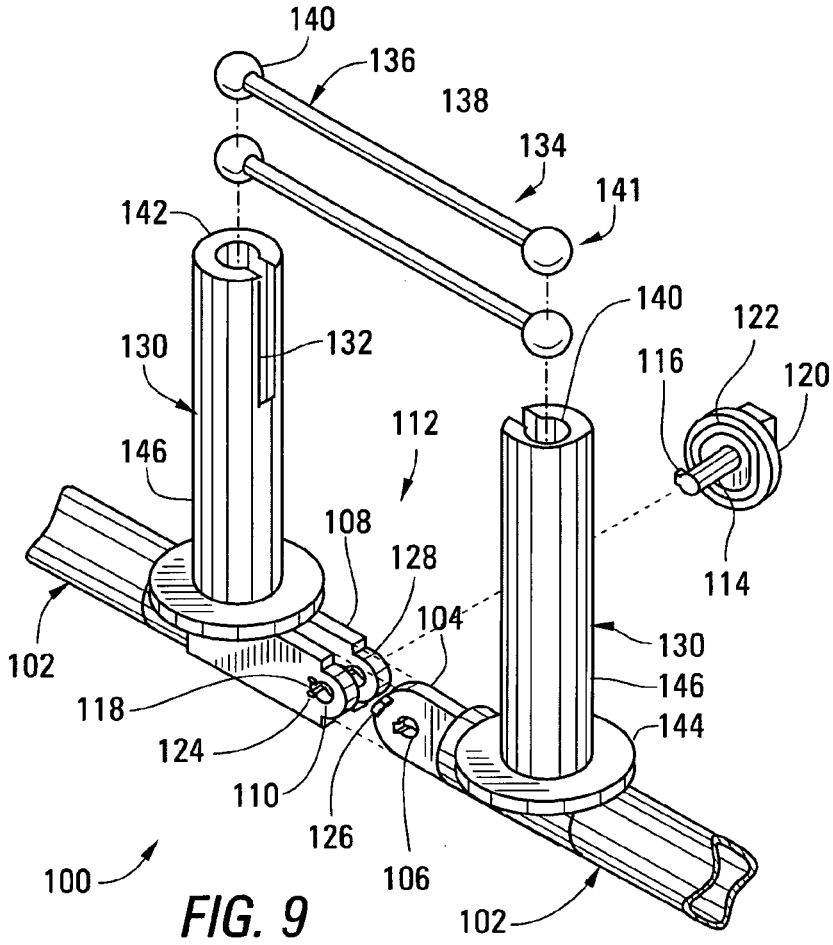
FIG. 9 is a fragmentary exploded view of exercise apparatus built in accordance with a second embodiment of the invention.

FIG. 9 is a fragmentary exploded view of exercise apparatus 100 built in accordance with a second embodiment of the invention to include a pair of L-shaped frame members 102, one of which includes a flat portion 104 having a pivot hole 106, while the other L-shaped frame member 102 includes a bifurcated portion 108 having two aligned pivot holes 110, with a central pivot 112 including a pin 114 extending through the two aligned pivot holes 110 of the bifurcated portion 108 and through the single pivot hole 106 of the flat portion 104, with the flat portion 104 disposed within the bifurcated portion 108. The pin 114 includes a key portion 116 extending outward from one side, which is inserted through keyways 118 in the pivot holes 106, 110. The pin 114 is fastened to a knob 120, so that the pin 114 can be easily inserted to assemble the apparatus 100 without tools, with the pin 114 being inserted through the pivot holes 106, 114 and turned after insertion to hold the pin in place as a pivot. The knob 120 is additionally provided with a wave spring washer 122 to maintain a tension force holding the pin 114 in place after it is inserted. Ridges 124 are provided adjacent a keyway 118 to prevent the inadvertent return of the key 116 to the keyway 118. A pivoting motion stop 126 extends from each side of the flat portion 104, moving through a recessed portion 128 to prevent pivoting movement of the L-shaped frame members to increase the angle between the outward extending legs beyond a first acute angle establishing an extended condition for the exercise apparatus 100.

Each of the forward-extending legs 130 of the L-shaped frame members 102 includes a slot 132 facing the other forward-extending leg 130. In this embodiment 100, a spring mechanism 134 includes at least one elastic member 136 having a central elastic portion 138 and a ball 140 at each end 141. These balls 140 hold the elastic member 136 in place within the forward-extending legs 130, with the central portion 138 extending between the slots 132 in the forward-extending legs 130. Preferably, the slot 132 within each of the forward-extending legs 130 extends into an opening 142 within an end 144 of the forward-extending leg 130, with the width of the slot being too small to permit the passage therethrough of one of the balls 140, but with the opening 142 within each of the legs 130 is large enough to permit passage of one of the balls 140, allowing the elastic member 136 to be added to the apparatus 100.

While a separately formed handgrip, in the manner of the handgrips 56 shown in FIG. 1, is not included within the apparatus 100, each of the forward-extending members 130 is of sufficient length to serve as a handgrip. A flange 144 is placed below a handgrip portion 146 of each of the forward-extending members 130.

Figure 10:
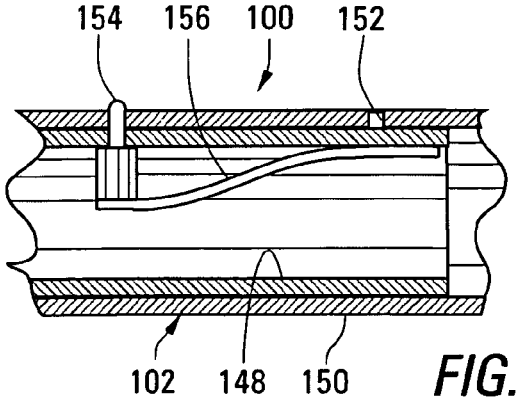
FIG. 10 is a fragmentary cross-sectional elevation of the exercise apparatus of FIG. 9, showing means for slidable attachment therein.

FIG. 10 is a fragmentary exploded view of the exercise apparatus 100, showing an alternate mechanism for attaching a slider 148 to an outward extending leg 150 of each of the L-shaped frame members 102. The slider 148 is attached to an arm engaging member that is similar to the concave arm engaging member 16 shown in FIGS. 1 and 2. The outward-extending leg 150 includes a plurality of attachment holes 152 spaced apart along its length to receive a pin 154 attached within the slider 148 by a spring 156 holding the pin 154, which extends through a hole 158 within the slider 148, in engagement with one of the attachment holes 152.

Thus, the second embodiment 100 of the invention includes features that are particularly suitable for assembly and disassembly in a rapid manner without using tools, allowing the L-shaped frame members 102 to be taken apart from one another and allowing the sliders 146 to be removed from the L-shaped members 102, so that the apparatus 100 can be easily carried in a briefcase.

Figure 11:
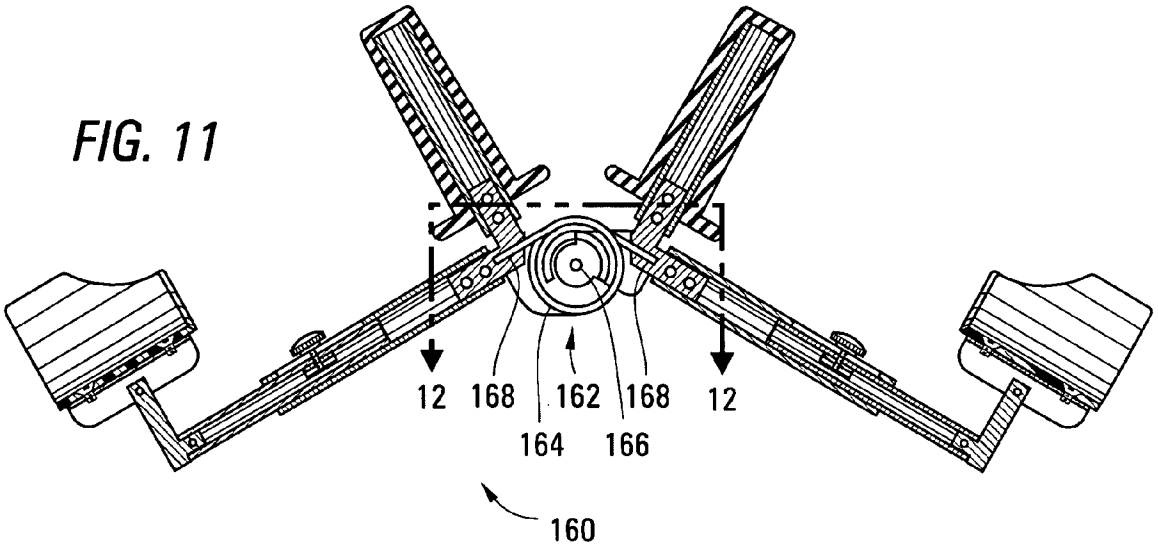
FIG. 11 is a cross-sectional plan view of exercise apparatus built in accordance with a third embodiment of the invention.
Figure 12:
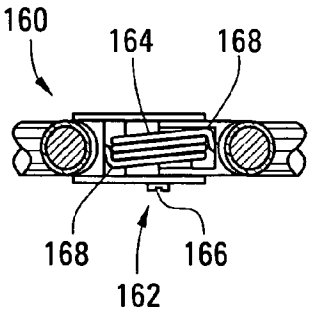
FIG. 12 is a fragmentary cross-sectional elevation of the exercise apparatus of claim 9, taken as indicated by section lines 12-12 therein.

A third embodiment of the invention will now be discussed with reference being made to FIG. 11, a cross-sectional plan view of exercise apparatus 160 built in accordance with the third embodiment, and to FIG. 12, s fragmentary cross-sectional elevation of the exercise apparatus 160, taken as indicated by section lines 12-12 in FIG. 11. The exercise apparatus 160 includes a spring mechanism 162 having a torsion spring 164, extending around a central pivot pin 166, with the torsion spring 164 having opposite ends 168 engaging two L-shaped frame members 170. Other aspects of the apparatus 160 are similar to aspects of the apparatus 10, built in accordance with the first embodiment of the invention, as described above in reference to FIGS. 1-4.

Figure 13:
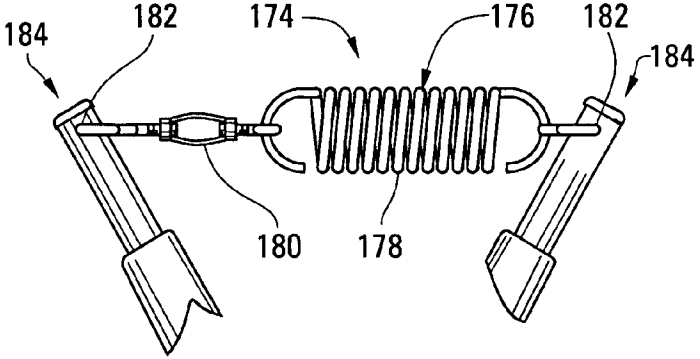
FIG. 13 is a fragmentary elevation of exercise apparatus built in accordance with a fourth embodiment of the invention.

FIG. 13 is a fragmentary elevation of exercise apparatus 174 built in accordance with a fourth embodiment of the invention to include a spring mechanism 176 having a coil spring 178 and a turnbuckle 180 for adjusting the force applied by the spring 178, with the spring 178 and the turnbuckle 180 being fastened to one another, extending between holes 182 in the ends 184 of the forward-extending legs 186 within the apparatus 174.

Figure 14:
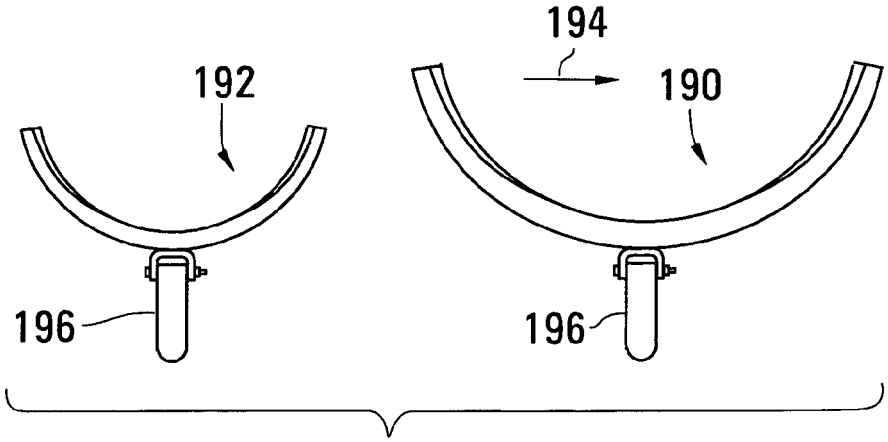
FIG. 14 is an end elevation showing a concave leg engaging member together with a concave arm engaging member, for interchangeable use in exercise apparatus built in accordance with the present invention.

The exercise apparatus of the invention may be additionally configurable for performing leg exercises. FIG. 14 is an end elevation showing a concave leg engaging member 190, a pair of which may be provided along with a pair of concave arm engaging members 192, with the concave leg engaging members 190 being substantially larger in width in the direction of curvature, as indicated by the direction of arrow 194, than the concave arm engaging members 192. The concave shape of both the leg engaging members 190 and the arm engaging members 192 is used to hold the exercise apparatus in place during exercise activities. Preferably, both the leg engaging members 180 and the arm engaging members 192 are attached to sliders 196 that can be easily installed and removed from the exercise apparatus, for example, as described above in reference to FIG. 10.

Figure 15:
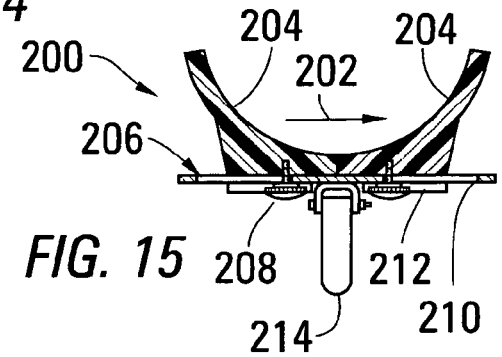
FIG. 15 is a cross sectional elevation of a concave arm engaging member that is variable in width to be additionally used as a leg engaging member in the exercise apparatus of FIG. 1.

FIG. 15 is a cross-sectional elevation of a concave arm engaging member 200 that is variable in width in the direction of curvature, as indicated by the direction of arrow 202, to be additionally used as a leg engaging member. For example, the concave arm engaging member 200, which can be used in the exercise apparatus 10 described above in reference to FIGS. 1-4, includes a pair of curved sections 204, attached to a support plate 206 by means of clamping screws 208, extending through slots 210 within the plate 206. The support plate 206 extends within a slot 212 in each of the curved sections 204, forming an arrangement allowing the curved sections 204 to be clamped at various locations providing different widths of the arm engaging member 200. The support plate 206 is attached to a slider 214 engaging, for example, one of the L-shaped frame members 20 of the exercise apparatus 10.

Figure 16:
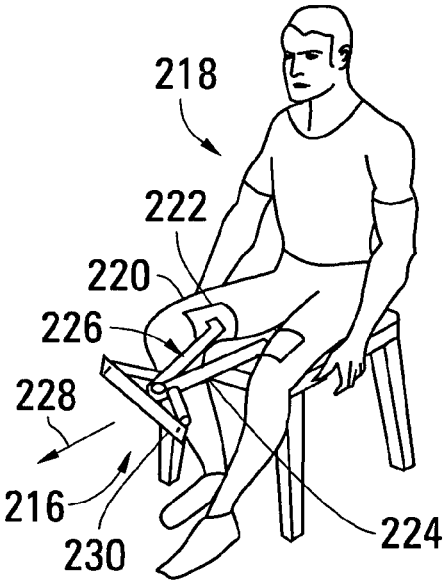
FIG. 16 is a perspective view of exercise apparatus, used for a leg exercise in accordance with the invention, being held in an extended condition by a user.
Figure 17:
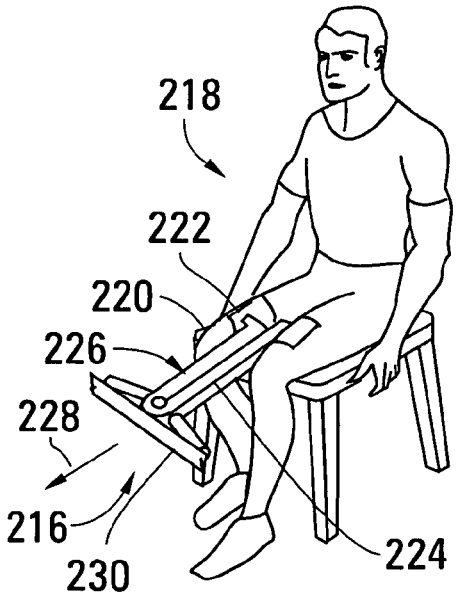
FIG. 17 is a perspective view of the exercise apparatus of FIG. 16, being held in a compressed condition by the user.

Thus, exercise apparatus built in accordance with the invention may be configured by the user for a leg exercise, which is then performed in a sitting position, as shown in FIG. 16, which shows the exercise apparatus 216 being held in an extended condition by a user 218, and FIG. 17, which shows the exercise apparatus 216 being held in a compressed condition by the user 218. The leg exercise method begins with placing each upper leg 220 within one of the concave leg engaging members 222 of the exercise apparatus 216, with the outward-extending legs 224 of the L-shaped frame members 226 extending forward, in the direction of arrow 228 and with the user's upper legs 220 spread apart to hold the exercise apparatus 216 in the extended condition. Then, the upper legs 220 are moved toward one another against the resistive force provided within the exercise apparatus 216 by the spring mechanism 230. Next, the upper legs 220 are moved apart to return the exercise apparatus 216 to the extended condition. These leg movements are repeated a number of times.

While the apparatus and methods for exercising have been described in preferred embodiment with some degree of particularity, it is understood that this description have been given only by way of example, and that numerous changes may be made without departing from the spirit and scope of the invention, as described in the appended claims.

What is claimed is:

1. Exercise apparatus comprising:

a central pivot;

a pair of L-shaped frame members, one of the L-shaped frame members includes a flat portion including a pivot hole and another of the L-shaped frame members includes a bifurcated portion including two aligned pivot holes pivotally attached to one another at the central pivot with a pin extending through the two aligned pivot holes of the bifurcated portion and through the through the pivot hole of the flat portion with the flat portion disposed within the bifurcated portion, wherein each of the L-shaped frame members includes an outward-extending leg extending outward from the central pivot and a forward-extending leg of sufficient length to form a hand grip, extending forward from the central pivot perpendicular to the outward-extending leg;

a concave arm engaging member attached to extend forward from each of the outward-extending legs; and spring means applying a force acting between the L-shaped members to oppose pivoting movement of the L-shaped frame members between an extended condition, in which the outward-extending legs extend outward with a first acute angle between the outward-extending legs, and a compressed condition in which the outward-extending legs extend rearward with an angle less than the first acute angle between the outward-extending legs.

2. The exercise apparatus of claim 1, wherein each of the concave arm engaging members is slidably attached to one of the L-shaped frame members.

3. The exercise apparatus of claim 2, wherein each of the concave arm engaging members is slidably attached to one of the L-shaped frame members by a slider sliding along the L-shaped frame member, and each of the concave arm engaging members is pivotally attached to the slider.

4. The exercise apparatus of claim 3, additionally comprising a clamping screw extending through a slot extending along the length of each of the outward-extending legs to hold one of the sliders in place at the outward-extending leg.

5. The exercise apparatus of claim 3, wherein each of the outward-extending legs includes a plurality of attachment holes spaced apart along its length, and each of the sliders includes a pin and a spring holding the pin in engagement with one of the attachment holes.

6. The exercise apparatus of claim 1, wherein each of the forward-extending legs includes a pin extending forward from its end, the spring means includes at least one elastic strap extending between the ends of the forward-extending legs; and holes at opposite ends of each of the at least one elastic strap engage the pins of the forward-extending legs.

7. The exercise apparatus of claim 1, wherein each of the forward-extending legs includes a slot facing the other forward-extending leg, the spring means includes at least one elastic member having a central elastic portion and a ball at each end, and the balls at the ends of each of the at least one elastic member hold the elastic member in place within the forward-extending legs with the central portion extending between the slots within the forward-extending legs.

8. The exercise apparatus of claim 7, wherein the slot within each of the forward-extending legs extends into an opening within an end of the forward-extending leg, the width of the slot within each of the forward-extending legs is too small to permit passage of one of the balls at the ends of the elastic members through the slot; and the opening within the end of each of the forward-extending legs is large enough to permit passage of one of the balls at the ends of the elastic members through the opening.

9. The exercise apparatus of claim 1, wherein the spring means includes a coil spring extending between ends of the forward-extending legs.

10. The exercise apparatus of claim 1, wherein the spring means includes a coil spring and a turnbuckle, fastened to one another, extending between ends of the forward-extending legs.

11. The exercise apparatus of claim 1, wherein the spring means includes a torsion spring, extending around the central pivot, having opposite ends engaging the two L-shaped frame members.

12. The exercise apparatus of claim 1, additionally comprising a pivoting motion stop preventing pivoting movement of the L-shaped frame members to increase the angle between the outward extending legs beyond the first acute angle.

13. The exercise apparatus of claim 1, wherein the central pivot includes a pin having a key portion extending outward from one side, inserted through holes having keyways in the L-shaped frame members and turned to hold the pin in place as a pivot.

14. The exercise apparatus of claim 1, wherein one of the L-shaped frame members includes a flat portion including a pivot hole, another of the L-shaped frame members includes a bifurcated portion including two aligned pivot holes, and the central pivot includes a pin extending through the two aligned pivot holes of the bifurcated portion and through the pivot hole of the flat portion with the flat portion disposed within the bifurcated portion.

15. The exercise apparatus of claim 1, wherein the concave arm engaging members are removably attached to the outward-extending legs, and the apparatus additionally includes a pair of concave leg engaging members, substantially wider in the direction of curvature than the concave arm engaging members, configured for removable attachment to the outward-extending legs in place of the concave arm engaging members.

16. The exercise apparatus of claim 1, wherein each of the concave arm engaging members is variable in width in the direction of curvature.

17. The exercise apparatus of claim 1, wherein each of the forward-extending legs includes a flange forwardly disposed from the central pivot.

18. A method for exercising, comprising;

(a) placing each forearm within a concave arm engaging member attached to an outward-extending leg of an L-shaped frame member of exercise apparatus including a pair of L-shaped frame members, pivotally attached at a central pivot, and spring means applying a force opposing pivoting movement of the L-shaped frame members between an extended condition, in which the outward-extending legs extend outward with a first acute angle between the outward-extending legs, and a compressed condition in which the outward-extending legs extend rearward with an angle less than the first acute angle between the outward-extending legs, with each hand holding a handgrip portion of a forward-extending leg of the L-shaped frame member, and with each upper arm held outward;

(b) moving each upper arm forward, with each forearm pivoting forward from the elbow, against a resistive force provided within the exercise apparatus by the spring means;

(c) moving each upper arm outward, with each forearm pivoting rearward from the elbow, as the exercise apparatus returns to the extended condition; and (d) repeating steps (b) and (c) a number of times.

19. The method of claim 18, additionally comprising:

(e) configuring the exercise apparatus to include a pair of concave leg engaging members substantially larger than the concave arm engaging members;

(f) placing each upper leg within one of the concave leg engaging members in a sitting position with the outward-extending legs of the L-shaped frame members extending forward and with the legs spread apart to hold the exercise apparatus in the extended condition;

(g) moving the upper legs toward one another against the resistive force provided within the exercise apparatus by the spring means;

(h) moving the upper legs apart to return the exercise apparatus to the extended condition; and (i) repeating steps (g) and (h) a number of times.

* * * * *